US005403221A

United States Patent [19]

Savage

[11] Patent Number: 5,403,221

[45] Date of Patent: Apr. 4, 1995

[54] AERIAL TOY WITH SHORT AXIS ROTATIONAL ASCENT AND LONG AXIS ROTATIONAL DESCENT

[76] Inventor: Daniel Savage, 2807 Westgate Ave., San Jose, Calif. 95125

[21] Appl. No.: 90,712

[22] Filed: Jul. 13, 1993

[51] Int. Cl.[6] ..... A63H 27/00

[52] U.S. Cl. ..... 446/45; 446/36

[58] Field of Search ..... 446/34, 61, 36, 45; 273/428

[56] References Cited

U.S. PATENT DOCUMENTS

| | | | |
|---|---|---|---|
| 1,413,316 | 4/1922 | Bradley | 446/34 |
| 2,105,579 | 1/1938 | Baylis | 446/45 |
| 2,238,713 | 4/1941 | Waring | 273/428 |
| 2,921,404 | 1/1960 | Lescher | 446/34 |
| 3,559,331 | 2/1971 | Eller | 446/34 |
| 3,665,641 | 5/1972 | Henderson | 446/45 |
| 3,675,926 | 7/1972 | Misevich | 446/36 X |
| 3,691,674 | 9/1972 | Thompson | 446/34 |
| 4,253,897 | 3/1981 | Pistone | 446/34 X |
| 4,466,213 | 8/1984 | Alberico et al. | 446/56 |
| 4,836,817 | 6/1989 | Corbin | 446/62 |
| 4,904,219 | 2/1990 | Cox | 446/36 |
| 4,997,401 | 3/1991 | Rose et al. | 446/64 |
| 5,013,277 | 5/1991 | Hufield | 446/34 |

*Primary Examiner*—Mickey Yu

[57] ABSTRACT

An aerial toy designed to maintain an aerodynamic profile during ascent by rotating around its shortest axis and having a shape which naturally predicts it to rotate around its longest axis during descent. The body of the invention consists of generally flat, thin, and light-weight, rigid construction (10) with an aerodynamic tapering edge (12). The body has a height that is longer than its width, and one half of the body height has more surface area than the other half.

13 Claims, 3 Drawing Sheets

Figure 3:
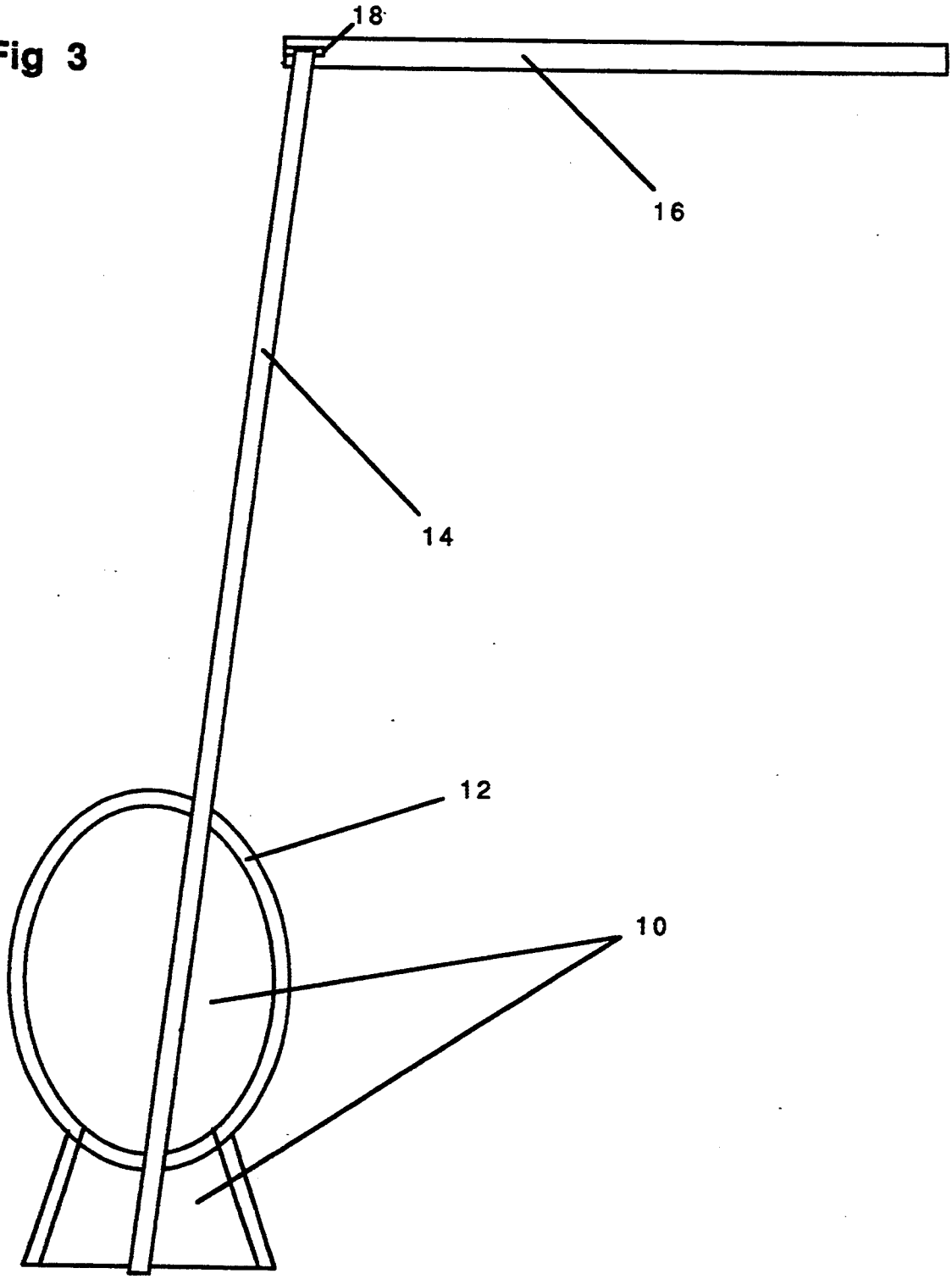

FIG. 1
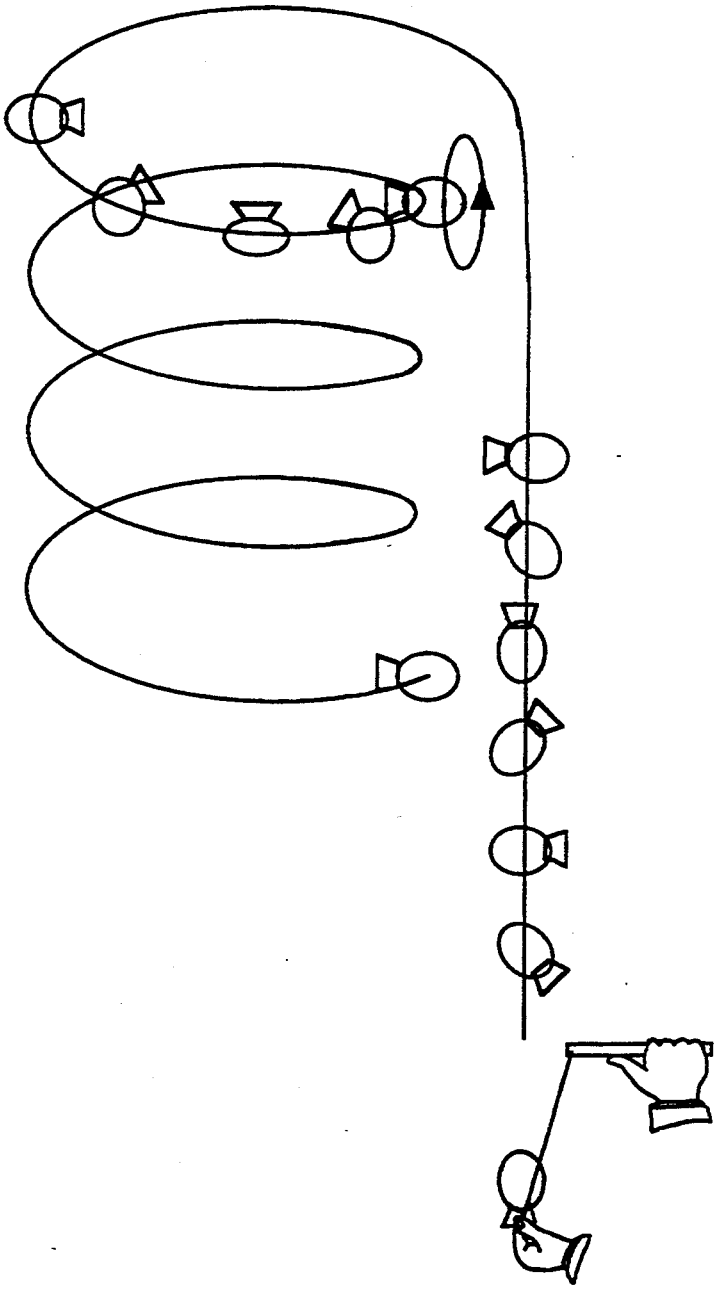
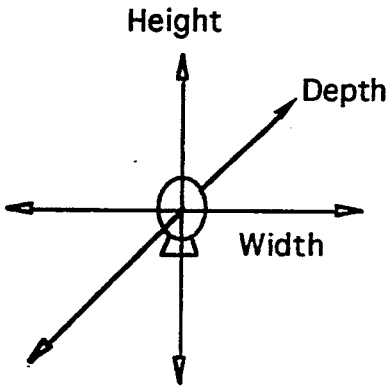
FIG. 2

AERIAL TOY WITH SHORT AXIS ROTATIONAL ASCENT AND LONG AXIS ROTATIONAL DESCENT

BACKGROUND-FIELD OF INVENTION

This invention relates to toys specifically to elastomer launched aerial toys that spin during descent.

BACKGROUND-DESCRIPTION OF PRIOR ART

Heretofore elastomer launched aerial toys have been primarily of two types. One type launches up and spins down in a spiral pattern: U.S. Pat. Nos. 4,904,219 to Cox (1990), 4,466,213 to Alberico (1984), 3,665,641 to Henderson (1972), 3,691,674 to Thompson (1972), 2,921,404 to Lescher (1960), 1,413,316 to Bradley (1922). The second type launches up and glides down: U.S. Pat. Nos. 5,013,277 to Hufeld (1991), 4,997,401 to Rose (1991). Previous aerial toys have been launched in a non-rotating fashion with a heavier or thickened end leading the ascent. Weighted areas are necessary to maintain a desirable aerodynamic orientation during flight. If one end of the device is not weighted more than the other, the toy will rotate during ascent exposing air retarding surfaces that reduce the toy's upward momentum. In addition, the same weights are necessary for the device to maintain a specific desired orientation for a gliding or spinning descent. The necessity of added weight to maintain aerodynamic orientation limits the maximum height of launch, and the time that the toy can stay airborne.

A problem in general with launched aerial toys is that the weight of the toy directly affects the height to which the toy can be launched by the elastic band. A toy that is 10 grams cannot be launched to the same height as a toy that is 5 grams. Most aerial toys have a significant weight, over 5 grams, which limits the height they can be launched. Because the weight limits the maximum height the toy can be launched, the maximum time the toy can stay airborne is also limited. In addition, besides affecting the launch height, the weight also speeds the toy's descent to back to Earth.

Many spinning aerial toys have been patented, all of these are of significant weight limiting their maximum height and time airborne. Some of the toy makers claim that their toy can easily be caught. The fact is unless the toy comes back almost directly to the operator, it will come down too fast to be caught by an average person. Due to a significant weight, the entire flight time of aerial spinning toys is on average about 6–8 seconds. By the time the operator determines which direction to run after the toy, 2 seconds have already passed. If the toy blows away from the operator more than 15.24 meters (50 feet), which is typical, the operator would have to run at speeds in excess of 24.14 kilometers/hour (15 miles/hour) to catch the toy. This is uncomfortably fast for most people. The amusement of catching these devices is only an option when the toy descends near the operator.

To increase the time spent airborne, the toy's weight must be decreased. Unfortunately, the lighter the toy is, the more it will be affected by air resistance during ascent. Previously it has been extremely difficult to launch an aerial toy with a weight of under two grams (superlight) to significant heights (over 15.24 meters, 50 feet) because the force of the air resistance encountered during ascent is more than enough to stop the toy's upward momentum. Air resistance is encountered by the hooking mechanism that allows the toy to be launched, the weighted or thicker areas that help maintain proper orientation during launch, and by the winged surfaces that are necessary for spinning or gliding during descent.

The solution of previous inventors to the air resistance problem during ascent has been to make the toy heavier so it will not be significantly affected by air resistance during the launch. This addition of weight limits the maximum height the toy can be launched and decreases the time the toy stays airborne. On another subject, previous aerial spinning toys have been too narrow and rod-like to incorporate a large variable surface area for amusing shapes, drawings, and pictures.

Besides aerial spinning toys, many aerial gliding toys exist. These toys are subject to the same physics problems as the spinning toys. An additional problem with the aerial glider toys is that the same aerodynamic profile that allows the toy to be launched also causes the toy to return to Earth very quickly unless it happens to catch an updraft. In general, gliding toys return to Earth even faster than the spinning toys. Many attempts have been made for aerial toys to maintain an aerodynamic profile during launch, and then change the profile during the downward return to Earth. These toys which attempt to deploy air retarding surfaces at sometime in the flight contain moving parts that tend to lose their flexibility and break after repeated use: U.S. Pat. Nos. 4,836,817 to Corbin (1989), and 2,105,579 to BayIls (1938).

Objects and Advantages

Accordingly some objects and advantages to my invention are:

(a) to provide an elastomer launched aerial toy that is rotated during ascent around its shortest axis providing a rotationally stable aerodynamic profile which allows a superlight object to be launched to heights previously unobtainable.

(b) to provide an aerial toy that maintains an aerodynamic profile during ascent without the addition of weights.

(c) to provide an aerial toy whose lack of weight allows it to be launched higher by the elastomer so it can remain airborne longer than previous elastomer launched toys.

(d) to provide an aerial toy consisting of a generally flattened, thin body shape that is more aerodynamic than previous aerial toys allowing this invention to be launched higher than similar toys.

(e) to provide an aerial toy that changes its aerodynamic profile to one of great air resistance during descent allowing the toy to float slowly back to Earth.

(f) to provide an aerial toy whose generally flattened shape consists of a height that is longer than the width causing the toy to rotate around the longer axis during descent. This rotation causing the toy to fall slowly back to Earth.

(g) to provide an aerial toy whose generally flattened shape consists of one half of the height having a greater surface area than the other half, causing a differential in air resistance that adds a spiraling motion to the rotation around the long axis.

(h) to provide an aerial toy whose lack of weight allows the toy to descend slower than any previous toy of generally similar operation.

(i) to provide an aerial toy that stays airborne long enough to be easily tracked and caught by the average person.

(j) to provide an aerial toy consisting of a flexible outer edge to prevent injury to the toy and to any person or object hit from an accidental impact.

(k) to provide an aerial toy which has no moving parts that would tend to become inflexible and break after repeated use.

(I) to provide an aerial toy whose generally flattened surface area can be varied and cut into amusing shapes.

(m) to provide an aerial toy whose generally flattened surface area allows for the addition of drawings and pictures to heighten the amusement of the toy.

(n) to provide an aerial toy whose generally flattened surface will allow the addition of light altering or light producing materials.

(o) to provide an aerial toy whose generally flattened surface can be cut to add holes allowing air to resonate and produce sound during ascent.

Further objects and advantages of my invention will become apparent from a consideration of the drawings and ensuing description of it.

DRAWING FIGURES

FIG. I provides an example flight path of the invention showing the rotation of the invention during ascent and descent.

FIG. 2 provides a representative of the invention orientated against a standard height, width, depth coordinate system.

FIG. 3 provides an enlarged frontal view of the invention and the launching apparatus.

Figure 4:
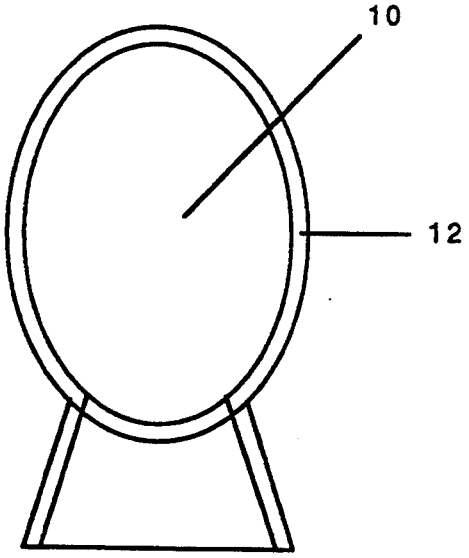

FIG. 4 provides a frontal view of the invention showing the invention construction.

Figure 5:
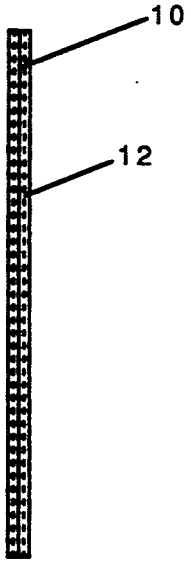

FIG. 5 provides a side view of the invention showing the invention construction.

Figure 6:
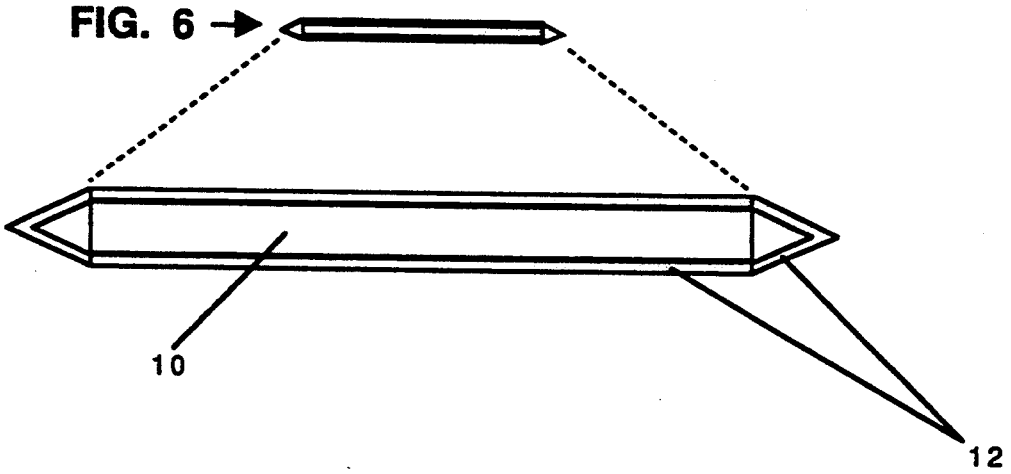

FIG. 6 provides a different side view of the invention including an enlarged side view of the invention construction.

DESCRIPTION-FIGS. 1 TO 6

The preferred embodiment as shown in FIGS. 4, 5, and 6 comprises a generally flattened, thin body shape of lightweight and rigid construction. The interior rigid structure 10 can be made of a foamed plastic such as expanded or extruded polystyrene. Balsa wood, paper, paperboard or other like materials can also be used.

The interior rigid structure 10 has a surface height that is longer than its width and/or a difference between the amount of surface area contained in the top and bottom half of the invention (height being the longest axis as shown in FIG. 2). The height/width ratio is necessary for the toy to rotate around the long axis during descent. The difference in surface area is necessary for the toy to exhibit a spiraling motion in addition to the rotational motion around the long axis during descent as shown in FIG. 1.

The interior rigid structure 10 in the preferred embodiment has a shape of an oval intersecting a triangle. Other shapes are possible. The height of the structure surface is of greater length than the width. The overall height of the structure is 8.89 centimeters (3.5 inches), and the width is 5.715 centimeters (2.25 inches) at its widest point.

The interior rigid structure 10 has a thickness of 1.5875 millimeters (0.0625 inches) to 0.79375 millimeters (0.0375 inches) if made of foamed plastic. Thinner materials such as paper and balsa wood are also useable if they are light and rigid enough to withstand the forces during launch. Since rigidity decreases as thickness decreases materials with internal structures such as cells and air pockets are most effective.

The interior rigid structure 10 is of weight less than 1 gram.

The flexible protective outer surface and aerodynamic edge 12 covers the interior structure on both sides of the invention as shown in FIG. 6. In addition, it extends beyond the interior structure's outline by approximately 3.175 to 9.525 millimeters ($\frac{1}{8}$th to $\frac{3}{8}$ths of an inch) and connects with itself to form the aerodynamic tapered edge. The outer surface extends the interior rigid shape in every direction as shown in FIG. 4. At the bottom of the invention where the elastic band will be placed during launch the flexible outer surface is removed so it won't be bent by the launch forces.

The flexible protective outer surface and aerodynamic edge 12 can be made from any flexible thin plastic such as polypropylene packaging tape which has a thickness of 0.05334–0.1067 millimeters. Similar thin plastics or paper products can also be used effectively.

The flexible protective outer surface and aerodynamic edge 12 has adhesive backing so that it will adhere to the interior structure and also to itself around the edges forming an aerodynamic tapered edge of thickness less than 0.2 millimeters.

On the protective outer surface 12 colorful designs in waterproof ink can be printed. The outer surface can also be made from several light altering plastics including diffracting, iridescent, and fluorescent materials.

The protective outer surface 12 can be translucent, transparent or opaque. In addition, light producing chemicals such as luminescent paint, or bioluminescent materials may be added to the outer surface for nighttime amusement.

The interior rigid structure 10 and flexible outer surface 12 can also include holes to cause air to resonate and produce sound during ascent.

If the interior rigid structure 10 can be molded to have a tapering aerodynamic edge, then the flexible outer surface may be disregarded altogether. Light altering and/or producing materials can then be placed directly on the interior rigid structure.

The dowel 16 that supports the elastic band 14, as shown in FIG. 3, can be made of plastic or wood or similar rigid material. A length of 20.32 centimeters (8 inches) and a diameter of 0.635 centimeters ($\frac{1}{4}$ inch ) works well for the dowel. The dowel contains a notch 18 to hold the elastic band. The notch is deep enough and thin enough to hold the band securely during repeated launches.

The elastic band 14 can be put in the notch 18 as in the preferred embodiment. If no notch is present, the elastic band can be looped around the dowel in a slip knot.

The Elastic Band 14 works well if it is a rubber band of length 15.24 centimeters (6 inches), width 0.9525 centimeters ($\frac{3}{8}$ths of an inch), and depth 0.318 centimeters ($\frac{1}{8}$th of an inch).

Operation-FIGS. 1, 4

The toy is launched by holding the dowel 16 steady with one hand, placing the toy between the two surfaces of the elastic band 14, as shown in FIG. 3, and pulling the elastic band and the toy down and slightly to the left if being released with the left hand as shown in FIG. 1. When the elastic band is released, it imparts a natural spin on the toy causing it to rotate counterclockwise if being pulled down with the left hand as shown in FIG. 1. This rotation gives the toy gyroscopic stability or rotational inertia during the launch. The gyroscopic stability allows the toy to maintain its orientation and its aerodynamic profile during ascent. As the toy continues upward, air resistance slows the initial rotation. When the rotation slows enough, the toy loses its gyroscopic stability and begins to become unstable. Because one axis of the toy surface is longer than the other, any perturbation of the toy around the shorter axis causes a rotation around the longer axis as shown in FIG. 1. This new rotation around the longer axis causes the toy to maintain an air retarding profile allowing it to descend very slowly. In addition, if there is a difference between the amount of surface area contained in the top and bottom half of the invention, as shown in FIG. 4, the toy will also exhibit a spiraling pattern caused by a difference in surface area subject to air resistance on each side of the toy. One half of the toy will be pushed by the air resistance more than the other causing the toy to maintain a spiral motion during descent as shown in FIG. 1. If the toy does not have a surface area difference between top and bottom half, it will still rotate around the longer axis and descend very slowly.

Summary, Ramifications, and Scope

Thus the reader will see that the aerial toy of my invention overcomes the air resistance problems previously encountered in attempts to launch a superlight toy to significant heights, thus providing a higher flying, slower descending aerial toy than has been designed previously. In addition, because my invention can stay airborne longer than previous similar inventions, it can be tracked and caught more easily. Lastly, my invention has a variable surface area that can be cut into amusing shapes which can further be enhanced by the addition of colored designs, light altering materials, and light producing materials.

While my above description contains many specificities, these should not be construed as limitations on the scope of the invention, but rather as an exemplification of one preferred embodiment thereof. Accordingly, the scope of the invention should be determined not by the embodiment illustrated, but by the appended claims and their legal equivalents.

I claim:

1. An aerial toy for projecting up into the air and free fall comprising:

a generally flat, thin body of a lightweight material having a planar first surface and a planar second surface defining a uniform thickness and weight throughout said body, said body further having a height longer than a width defining an elongated shape having a longitudinal axis, said body is further shaped to have a surface area greater at a first half of said body than a second half of said body, and a symmetrically tapered edge of a flexible material extending continuously around the periphery of said body except for a single break adopted for allowing a launcher to engage said body during launching, whereby, on free fall, said elongated shape causes said body to rotate about said longitudinal axis, and said greater surface area at said first half causes said body to rotate about said second half exhibiting a spiraling motion throughout its free fall.

2. An aerial toy of claim 1 wherein said first surface and second surface are covered by respective first and second covers of a flexible material, and said first and second covers are integrally formed with said tapered edge.

3. The invention of claim 1 further including an elastomer launching mechanism consisting of an elastomer, having means for engaging said body, attached to a rigid piece whereby a user may grasp the rigid piece in one hand and launch said body by said elastomer.

4. An aerial toy for projecting up into the air and free fall comprising:

a generally flat, thin body of a lightweight material having a planar first surface and a planar second surface defining a uniform thickness and weight throughout said body, said body further having a height longer than a width defining an elongated shape having a longitudinal axis and a lateral axis, said lateral axis being perpendicular to said planar first surface and said planar second surface, said lateral axis passing through a point central to said body, said aerial toy having at least four operational modes including:

a) a launch mode in which a launcher exerts an upward force on said body, said force acting along a line which passes through said body approximately parallel to said planar first surface and said planar second surface, said line being offset from said lateral axis such that said force simultaneously imparts to said body an upward motion and a rotational motion about said lateral axis, b) an ascending mode in which said body ascends while simultaneously rotating about said lateral axis, the rotation of said body about said lateral axis serving to aerodynamically stabilize said body while ascending such that said planar first surface and said planar second surface of said body remain parallel to the direction of motion of said body while ascending, c) a transitional mode in which said body is perturbed from the aerodynamically stable ascent of the ascending mode and said body ceases to ascend and to rotate about said lateral axis, and d) a descending mode in which said body descends in free fall while simultaneously rotating about said longitudinal axis of said body, the rotation of said body about said longitudinal axis serving to retard the descent of said body, said body is shaped to have a surface area greater at a first half of said body than a second half of said body causing said body to rotate about said second half exhibiting a spiraling motion throughout its free fall in said descending mode.

5. The aerial toy of claim 4 wherein said first half of said body is in the shape of an oval, and said second half of said body is in the shape of a triangle intersecting said oval.

6. The aerial toy of claim 4 further comprising an elastomeric launching mechanism consisting of an elastomer, having means for engaging said body, attached to a rigid piece whereby a user may grasp the rigid piece in one hand and launch said body by said elastomer.

7. The aerial toy of claim 4 further comprising a symmetrically tapered edge of a flexible material extending continuously around the periphery of said body except for a single break adapted for allowing said launcher to engage said body during launching.

8. The aerial toy of claim 7 wherein said planar first surface and said planar second surface are covered by respective first and second covers of a flexible material, and said first and second covers are integrally formed with said tapered edge.

9. The aerial toy of claim 4 wherein said body has holes with means for producing sound.

10. The aerial toy of claim 4 further comprising lighting means for lighting said planar first surface and said planar second surface.

11. The aerial toy of claim 10 wherein said lighting means is chosen from the group consisting of bioluminescent chemicals, luminescent paint, and light emitting diodes.

12. The aerial toy of claim 4 further comprising light altering materials.

13. The aerial toy of claim 12 wherein said light altering materials are chosen from the group consisting of diffraction materials, iridescent materials, and fluorescent materials.

* * * * *